US006554509B2

(12) United States Patent
Wu et al.

(10) Patent No.: US 6,554,509 B2
(45) Date of Patent: Apr. 29, 2003

(54) CROSS TYPE SUPPORTER MOUNTING SYSTEM FOR A NOTEBOOK COMPUTER KEYBOARD AND THE METHOD FOR MOUNTING THE SAME

(75) Inventors: Ming-Rong Wu, Taipei (TW); Chi-Hsiang Wang, Taipei (TW)

(73) Assignee: Silitek Corporation, Taipei Hsien (TW)

( * ) Notice: Subject to any disclaimer, the term of this patent is extended or adjusted under 35 U.S.C. 154(b) by 27 days.

(21) Appl. No.: 09/826,882

(22) Filed: Apr. 6, 2001

(65) Prior Publication Data

US 2002/0146269 A1 Oct. 10, 2002

(51) Int. Cl.[7] ..... B41J 5/52
(52) U.S. Cl. ..... 400/472; 400/719
(58) Field of Search ..... 400/472, 490, 400/492, 691, 692, 693, 719

(56) References Cited

U.S. PATENT DOCUMENTS 4,046,981 A * 9/1977 Johnson et al. ..... 200/159 B
4,911,598 A * 3/1990 Sarvary et al. ..... 414/225
4,927,479 A * 5/1990 Bock ..... 156/228
5,193,426 A * 3/1993 Dunn ..... 83/277
6,138,964 A * 10/2000 Rose et al. ..... 248/123.11

* cited by examiner

*Primary Examiner*—Anthony H Nguyen
(74) *Attorney, Agent, or Firm*—Rosenberg, Klein & Lee

(57) ABSTRACT

A cross type supporter mounting system for a notebook computer keyboard comprises: a first platform for placing a computer keyboard and movable along an approximate horizontal direction; a second platform movable along a vertical direction and being positioned above the first platform; and a press plate installed between the first platform and the second platform. Thereby, by the pressure of the machining table with the operation of a press plate having a special pattern and cylinders, the last two steps in the assembling process is automatized. Therefore, the labor in the assembling process is reduced. Yield ratio is increased and the cost is decreased.

8 Claims, 12 Drawing Sheets

CROSS TYPE SUPPORTER MOUNTING SYSTEM FOR A NOTEBOOK COMPUTER KEYBOARD AND THE METHOD FOR MOUNTING THE SAME

FIELD OF THE INVENTION

The present invention relates to a cross type supporter mounting system for a notebook computer keyboard and the method for mounting the same, and especially to semi-auto cross type supporter mounting system for a notebook computer keyboard and the method of the same.

BACKGROUND OF THE INVENTION

Referring to FIGS. 1 and 2, the key of a computer keyboard is formed by a cap 11, a touch moving elastomer 12, a first supporter 13, a second supporter 14 and a seat 15. The center at each of two sides of the first supporter 13 is installed with a respective pivotal shaft 16 and a pivotal hole 17 so that the first supporter 13 and second supporter 14 are pivotally connected as a cross type linking structure. The touch moving elatomer 12 is installed between the cap 11 and the seat 15 and is positioned in the travelling path of the cap 11. The lower ends of the two sides of the first supporter 13 and second supporter 14 are installed with respective pivotal shafts 18 and 19 pivotally connected to the through holes 20, 21 preset on the seat 15. The through holes 20 and 21 are installed with positioning pieces 22 and 23, respectively for confining the pivotal shafts 18 and 19 to move upwards. Besides, a spacer 24 is further installed at a lateral side of the second supporter 14. Thereby, as the first supporter 13 and second supporter 14 are placed into the through holes 20 and 21, the first supporter 13 and second supporter 14 are prevented from sliding out.

In assembling such a key structure, the most complex structure is the assembly of the first supporter 13 and the second supporter 14. In general, the operator needs to pivotally cross the first supporter 13 and second supporter 14. Then, the pivotal shaft 18 below the first supporter 13 is installed in a respective through hole 20. Then, an upper force is applied thereon so that the pivotal shaft 18 at the lower end of the second supporter 14 is pushed into a respective through hole 21, and then a horizontal outer force is applied the cross structure formed by the first supporter 13 and the second supporter 14 so that the second supporter 14 is stopped by the spacer 24 so as not to slide out of the structure.

In this method, it is often that the pivotal shaft 19 at lower end of the second supporter 14 is deformed by outer forces due to an improper applied force. Furthermore, since the volumes of the first supporter 13 and second supporter 14 are too small, manual assembly is not economical. Therefore, in practical assembly, it will induce a great inconvenience.

SUMMARY OF THE INVENTION

Accordingly, the primary object of the present invention is to provide a cross type supporter mounting system for a notebook computer keyboard and the method for mounting the same, and especially to semi-auto cross type supporter mounting system for a notebook computer keyboard and the method of the same. Therefore, the labor in the assembling process is reduced. Yield ratio is increased and the cost is decreased.

To achieve the objects, the present invention provides a cross type supporter mounting system for a notebook computer keyboard comprising: a first platform for placing a computer keyboard and movable along an approximate horizontal direction; a second platform movable along a vertical direction and being positioned above the first platform; and a press plate installed between the first platform and the second platform. Thereby, by the pressure of the machining table with the operation of a press plate having a special pattern and cylinders, the last two steps in the assembling process is automatized. Therefore, the labor in the assembling process is reduced. Yield ratio is increased and the cost is decreased.

The various objects and advantages of the present invention will be more readily understood from the following detailed description when read in conjunction with the appended drawing.

DETAILED DESCRIPTION OF THE PREFERRED EMBODIMENTS

Figure 1:
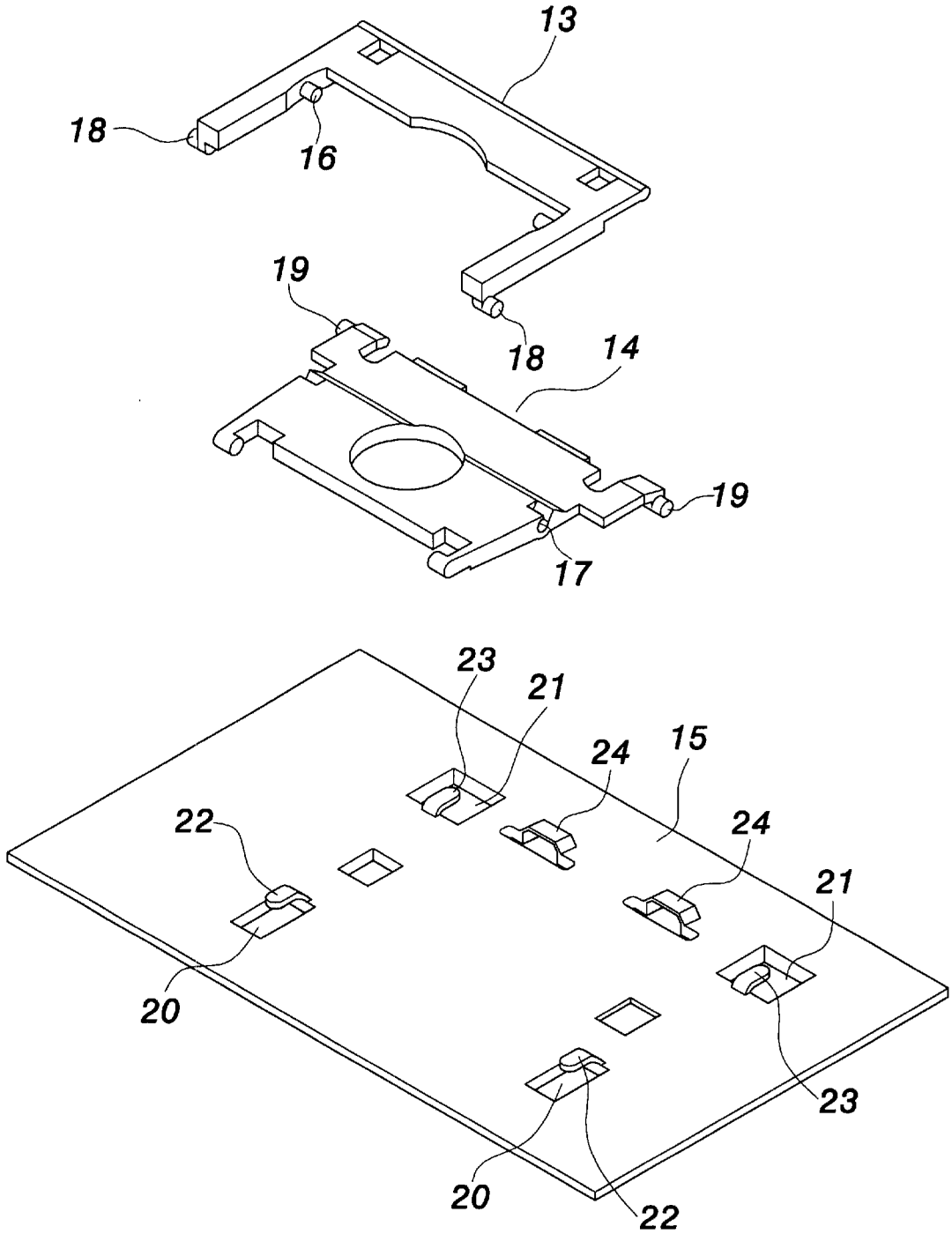
FIG. 1 PRIOR ART
FIG. 1 is a perspective view of a key of a prior art notebook computer keyboard.
Figure 2:
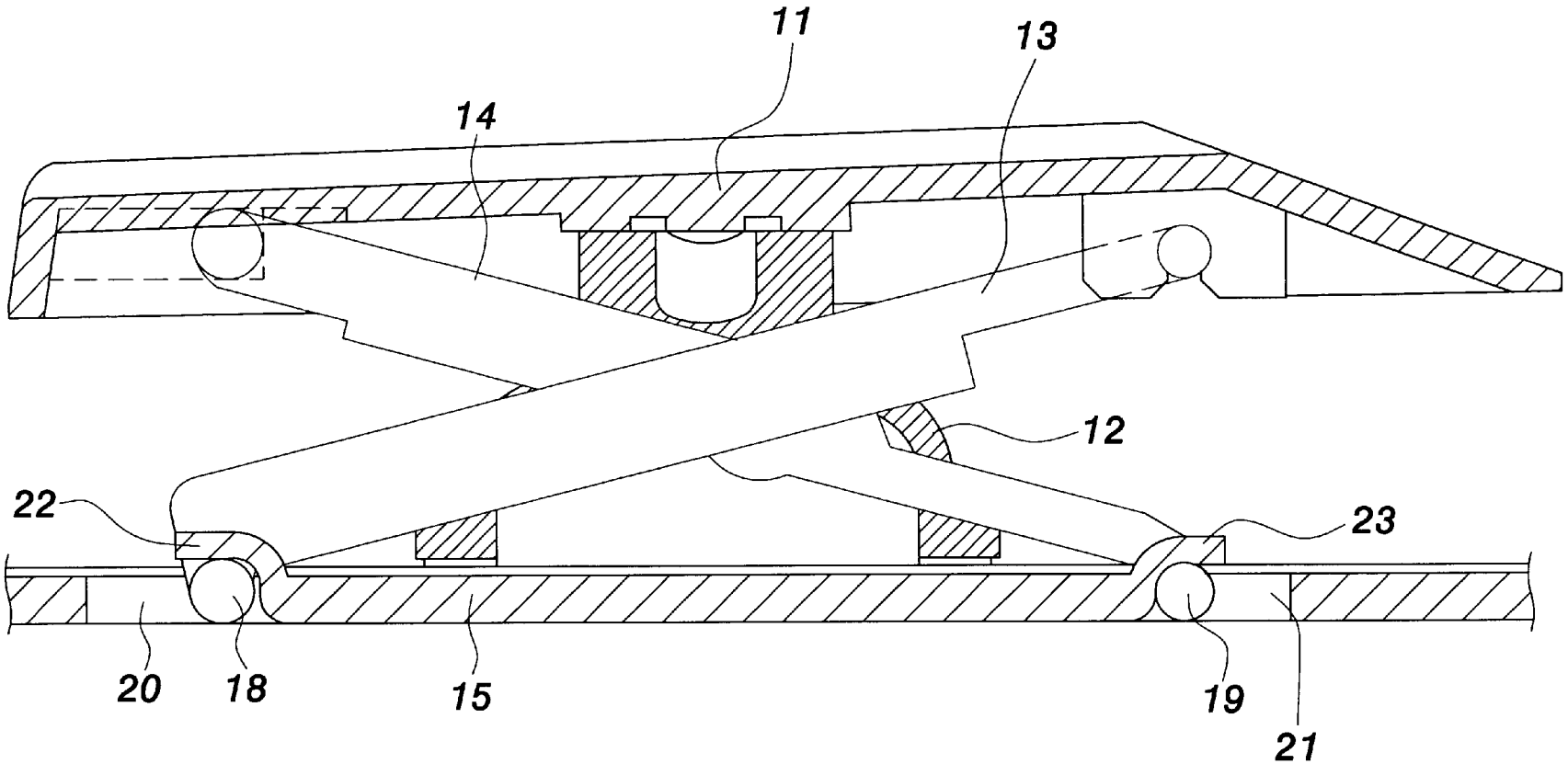
FIG. 2 PRIOR ART
FIG. 2 is plane view of a key of a prior art notebook computer keyboard.
Figure 3A:
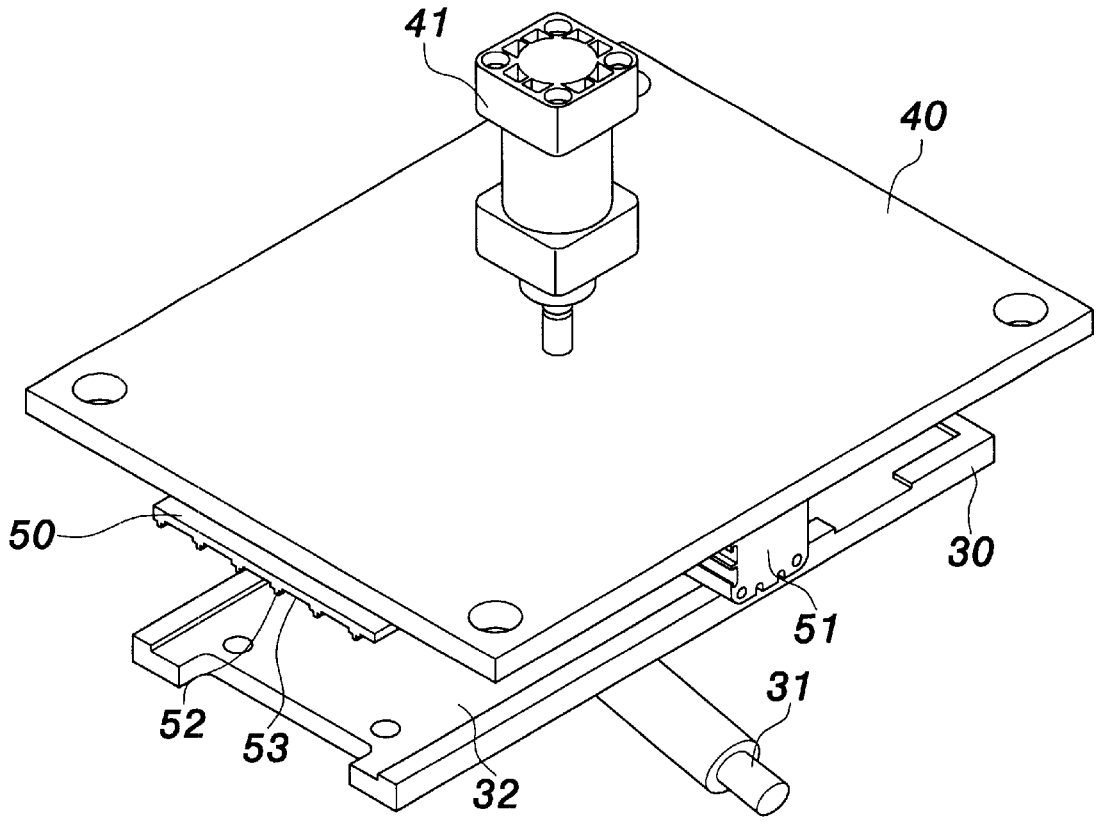
FIG. 3A is a perspective view of the mounting system of the present invention.
Figure 3B:
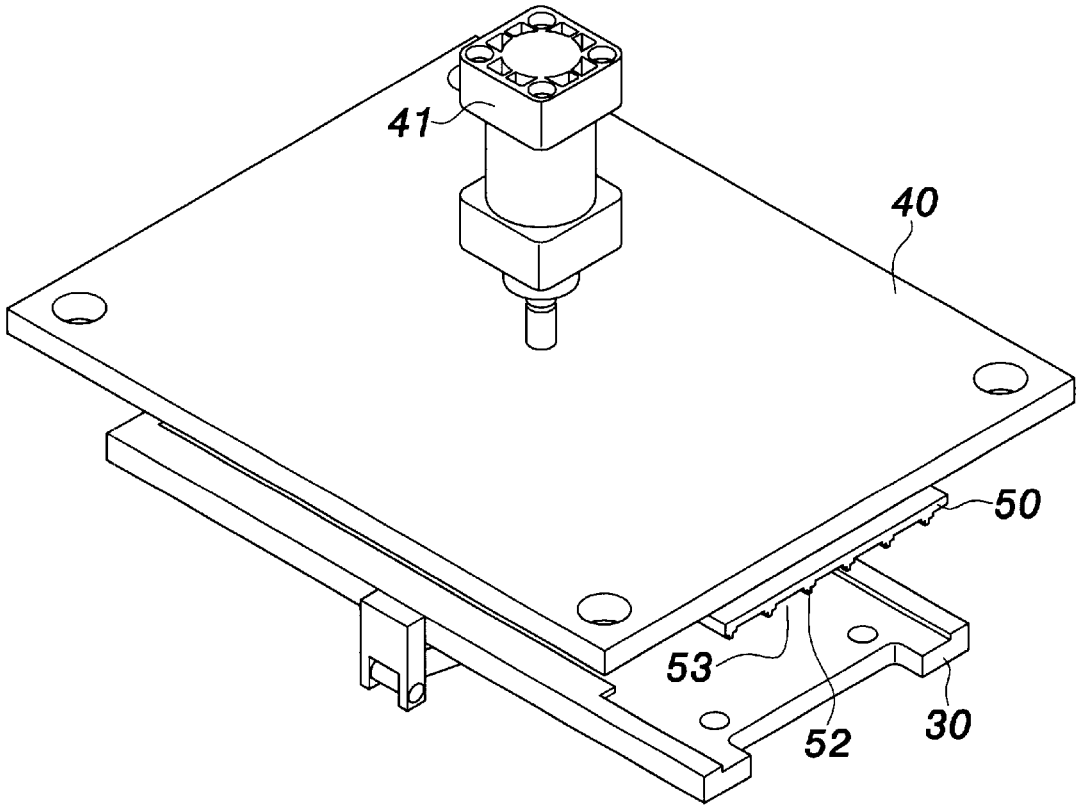
FIG. 3B is a perspective view of the mounting system of the present invention viewing from another visual angle.
Figure 4A:
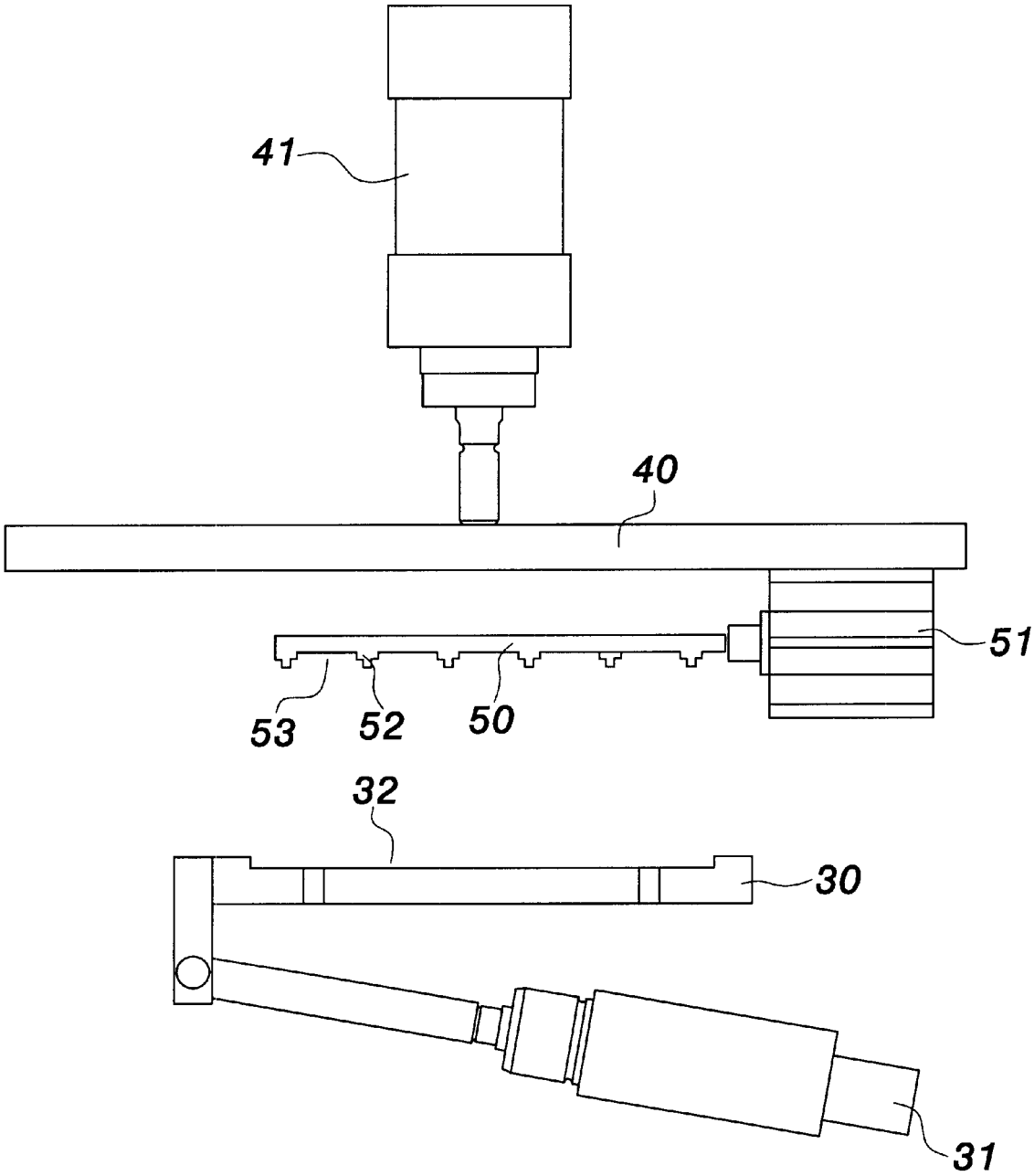
FIG. 4A is a front view of the mounting system of the present invention.
Figure 4B:
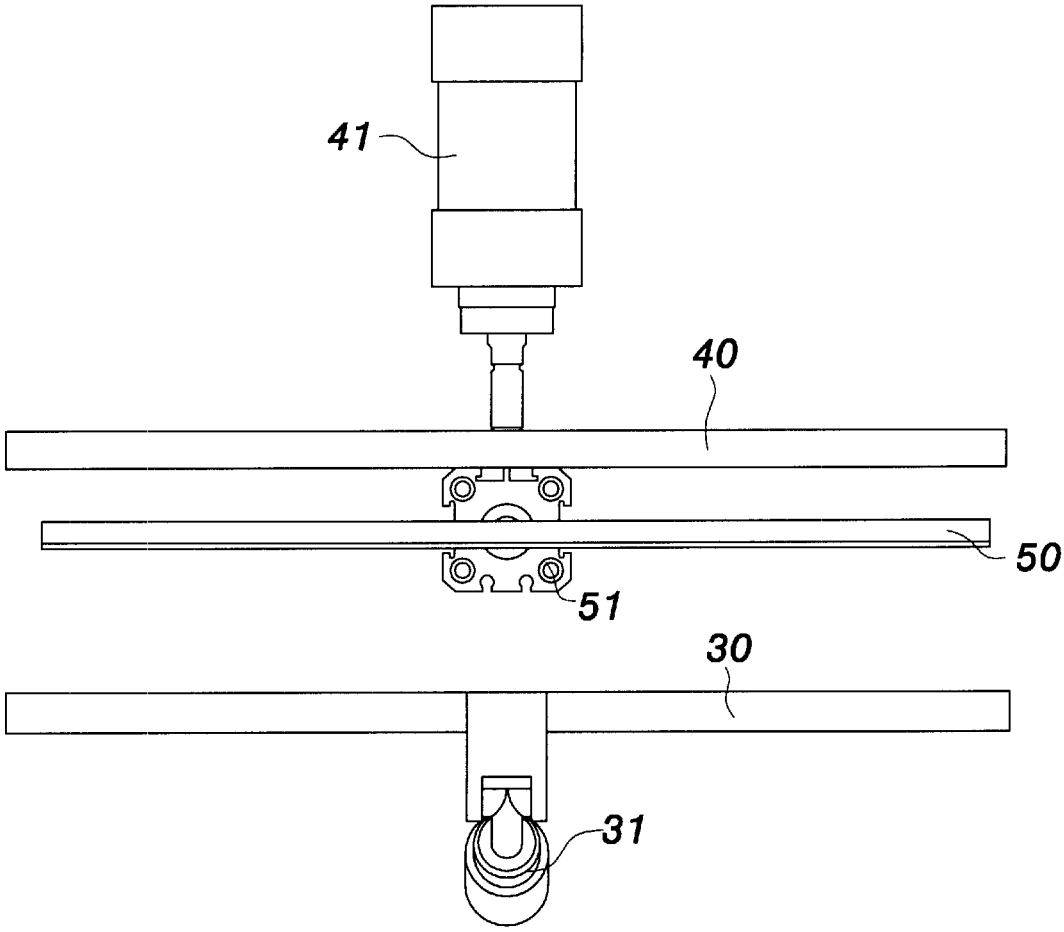
FIG. 4B is a lateral view of the mounting system of the present invention.
Figure 5:
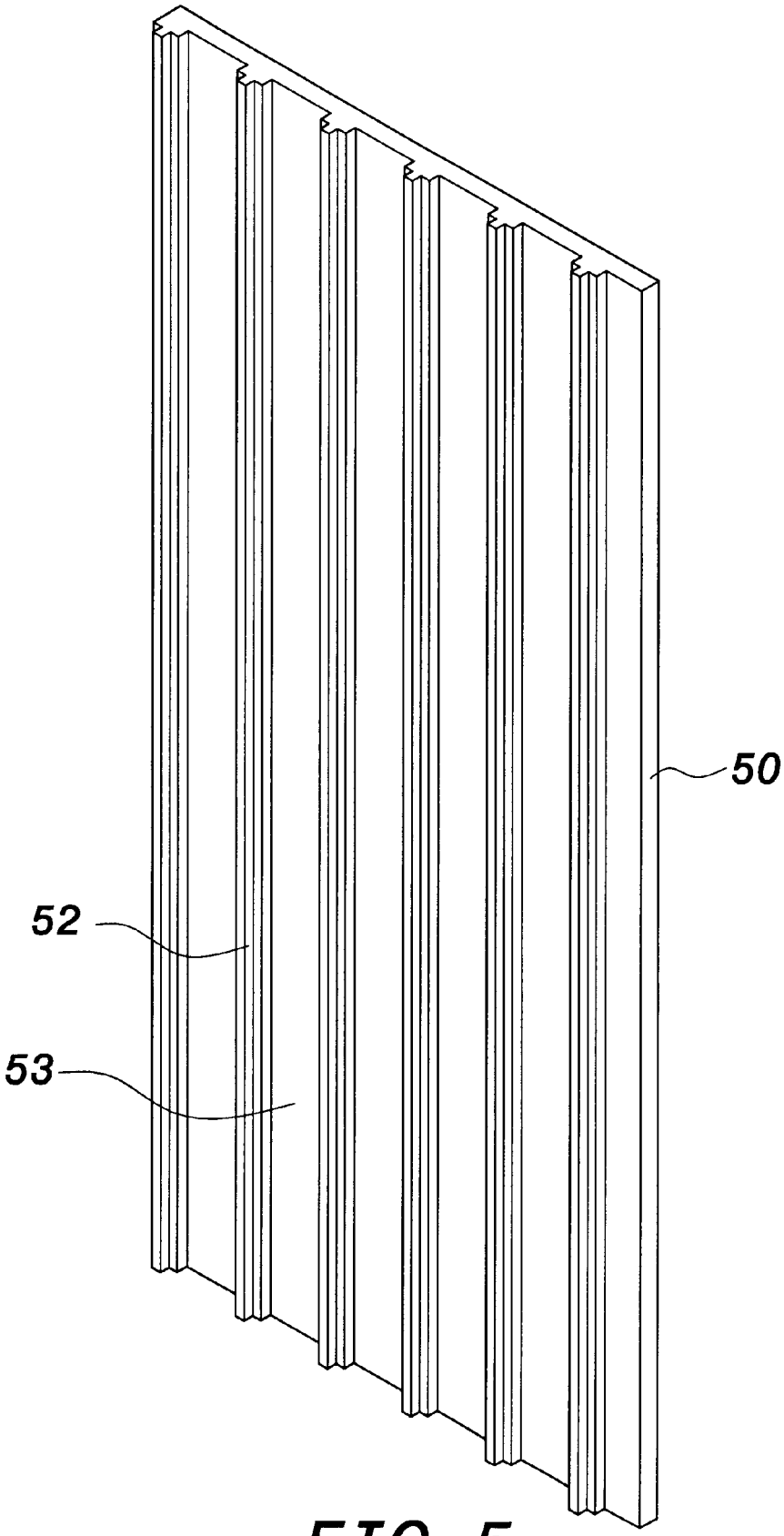
FIG. 5 is a perspective view showing the press plate of the present invention.
Figure 6A:
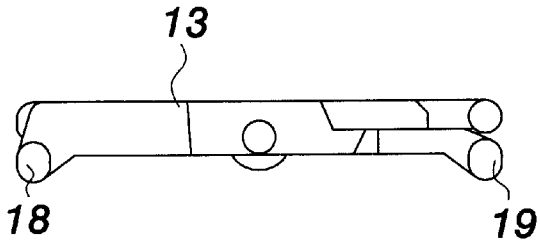
FIG. 6A is a lateral view of the cross type supporter in the present invention.
Figure 6B:
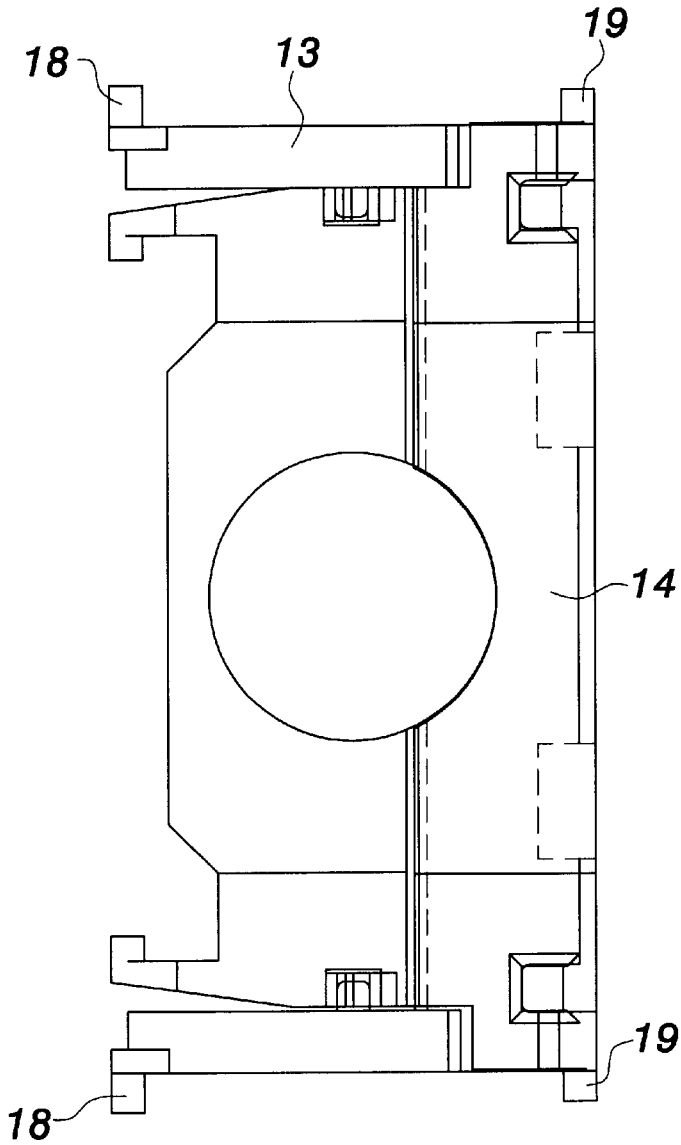
FIG. 6B is an upper view of the cross type supporter in the present invention.
Figure 6C:
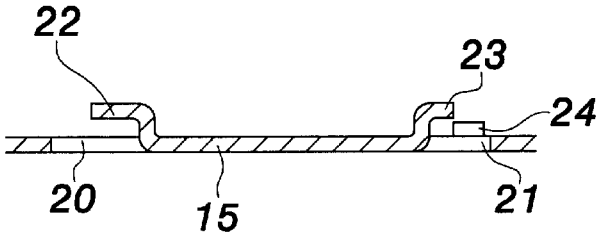
FIG. 6C is a lateral view of the seat in the present invention.
Figure 6D:
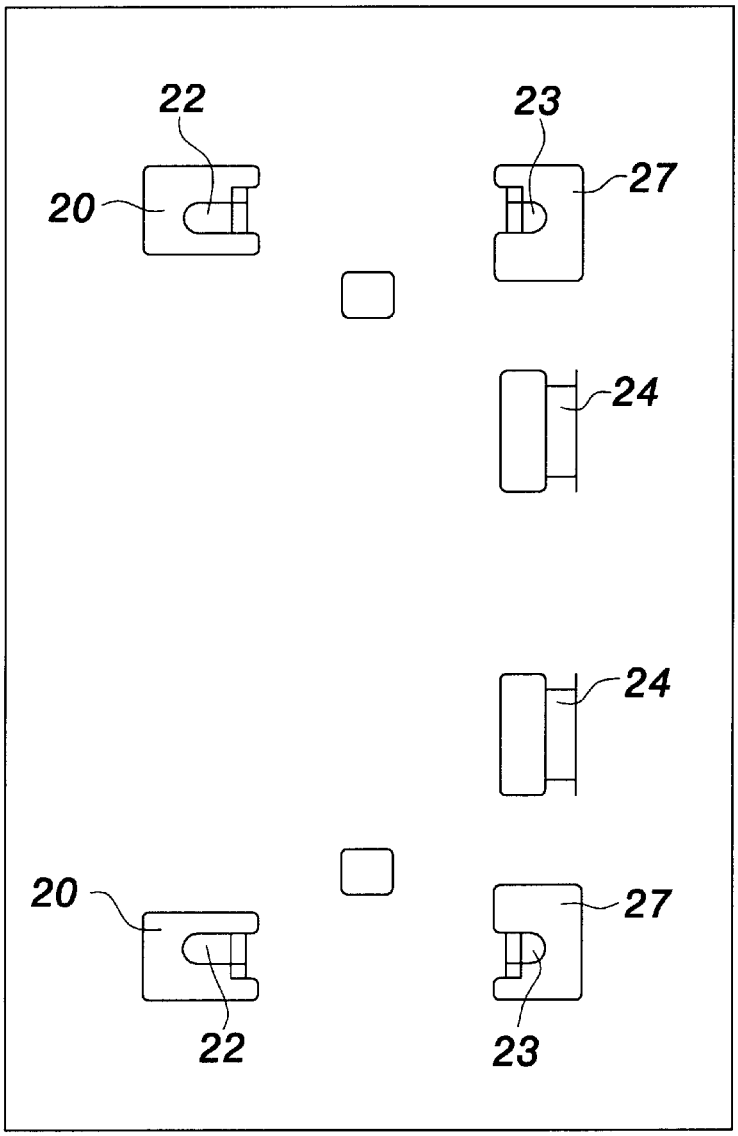
FIG. 6D is an upper view of the seat in the present invention.

Referring to FIGS. 3A, 3B, 4A and 4B, the cross type supporter mounting system for a notebook computer keyboard of the present invention is illustrated. The cross type supporter mounting system of the present invention includes a first platform 30 movable along an approximate horizontal direction, a second platform 40 movable along a vertical direction, and a press plate 50 having a special pattern and movable along a horizontal direction. The first platform 30 is movably installed in the system and is connected with a feeding cylinder 31. The feeding cylinder 31 is properly fixed in the system. The first platform 30 can be driven along an approximate horizontal direction by the feeding cylinder 31. A placing surface 32 is formed at a top of the first platform 30 for placing a computer keyboard to be mounted. The second platform 40 is movably installed in the system and is above the first platform 30 with a proper height, and further, is connected with a press cylinder 41. The press cylinder 41 is properly fixed to the system. The second platform 40 can be driven by the press cylinder 41 to move along a vertical direction. The press plate 50 is movably installed between the first platform 30 and the second platform 40 and is connected to a pull cylinder 51. The pull cylinder is properly fixed to the bottom of the second platform 40. The press plate 50 can be driven by the pull cylinder 51 to move along a horizontal direction. The bottom of the press plate 50 is installed with a plurality of protrusions 52 having a ladder shape (see FIG. 5). A recess 53 is formed between two protrusions 52 for receiving a cross type supporter. Therefore, by the aforesaid components, a cross type supporter mounting system for a notebook computer keyboard of the present invention is formed.

In this the present invention, the movement of the first platform 30, second platform 40, and press plate 50 are achieved through three cylinders 31, 41, and 51. Of course, the cylinders may be oil pressure cylinders or other types.

Figure 7A:
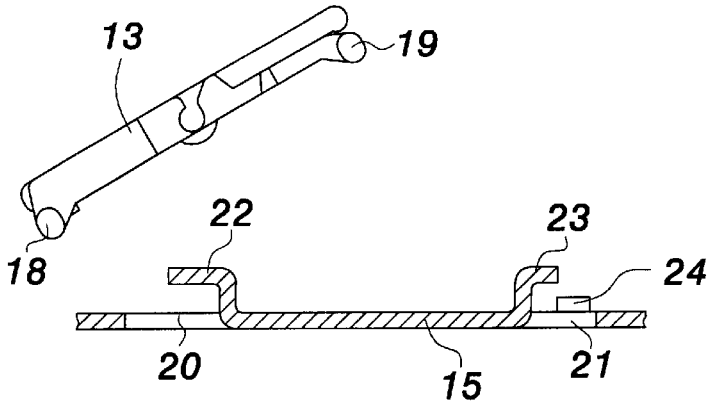
FIGS. 7A~7F is a schematic view showing the mounting system of the present invention.
Figure 7B:
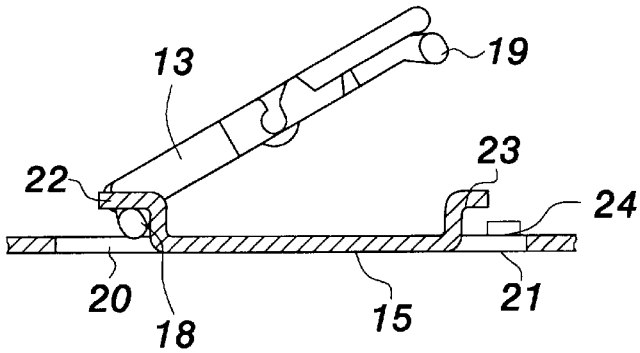
Figure 7C:
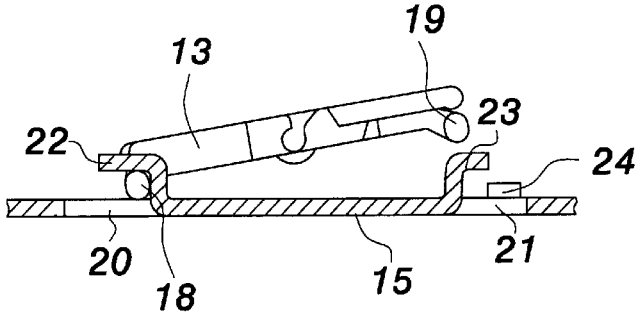
Figure 7D:
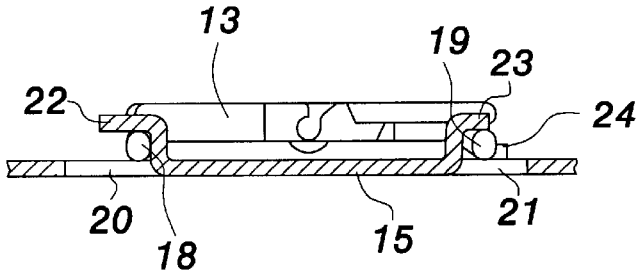
Figure 7E:
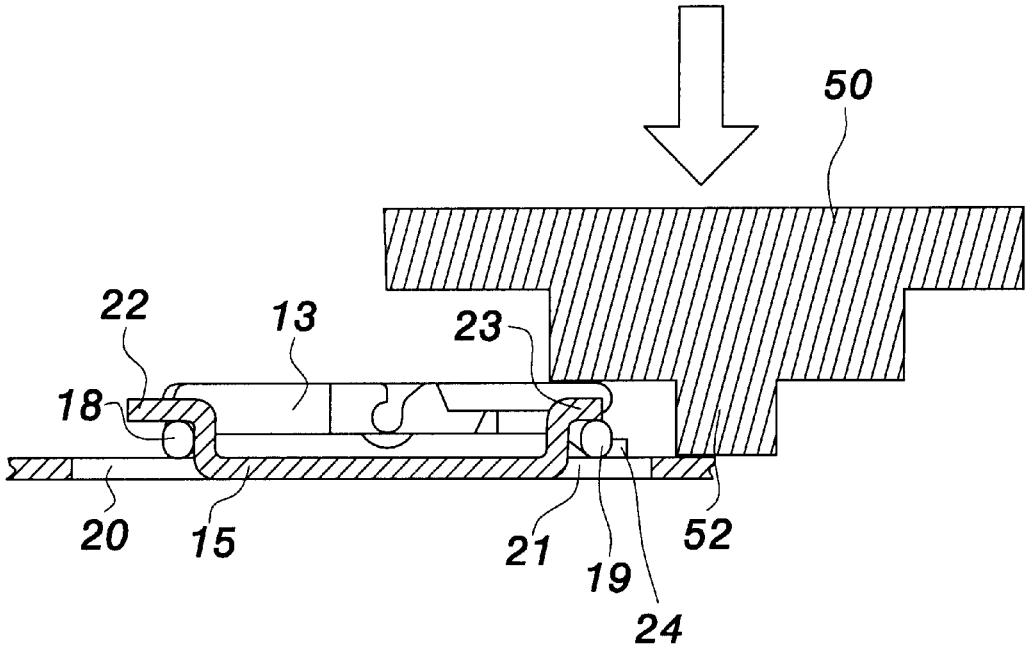
Figure 7F:
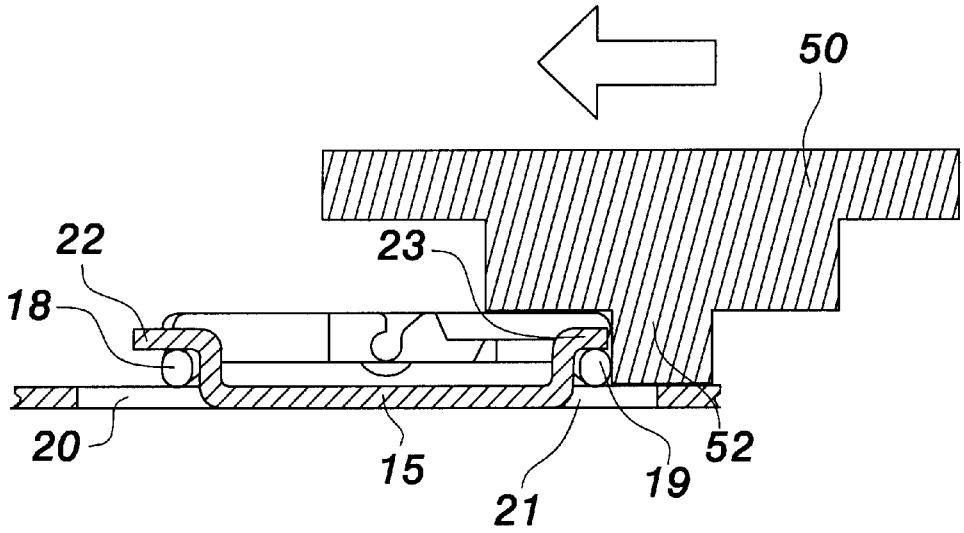
Figure 8:
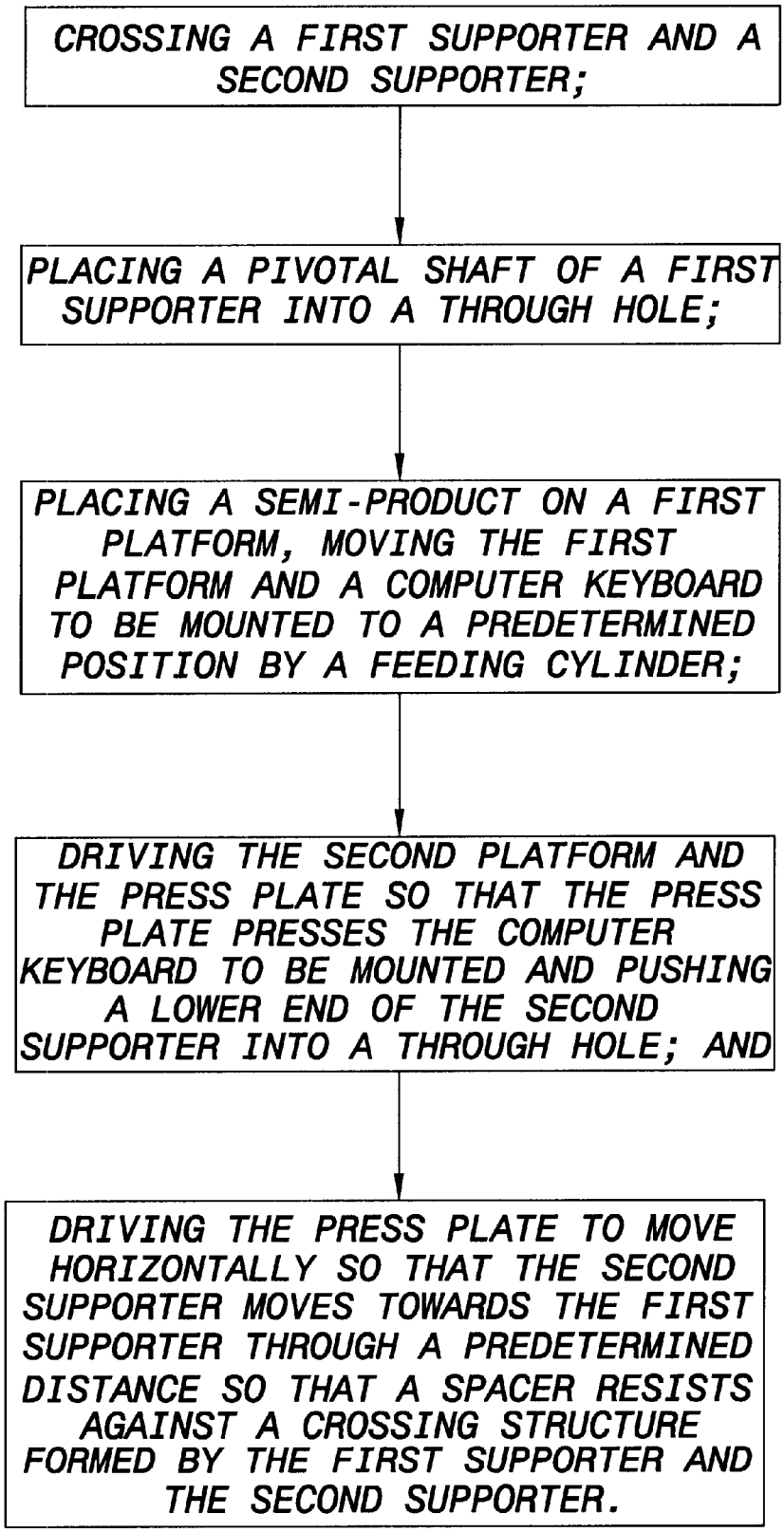
FIG. 8 is a flow diagram of the mounting system in the present invention.

With reference to FIGS. 6A–6D, the cross type supporter and seat of the present invention and other related drawings are illustrated. Further, referring to FIGS. 7A–7D, and FIG. 8, the mounting system and operating steps of the present invention are illustrated. The process of the present invention includes the steps of:

(1) at first, crossing the first supporter 13 and second supporter 14 (referring to FIG. 7A);

(2) then, placing the pivotal shaft 18 of the first supporter 13 into the through hole 20 (referring to FIG. 7B);

(3) then, placing a semi-product on the first platform 30, moving the first platform 30 and a computer keyboard to be mounted to a predetermined position by the feeding cylinder 31;

(4) next, driving the second platform 40 and the press plate 50 by the pressing cylinder 41 so that the press plate 50 presses the computer keyboard to be mounted and a lower end of the second supporter 14 is pushed into a through hole 21 (referring to FIGS. 7C and 7D);

(5) next, the pull cylinder 51 driving the press plate 50 to move horizontally so that the second supporter 14 moves towards the first supporter 13 through a predetermined distance (referring to FIGS. 7E and 7F) so that a spacer 24 resists against the crossing structure formed by the first supporter 13 and the second supporter 14.

The present invention provides a semi-automatic cross type supporter mounting system for a notebook computer keyboard and the method for mounting the same. In the present invention, the pressure of the machining table with the operation of a press plate having a special pattern and cylinders, the last two steps in the assembling process are automatized. Therefore, the labor in the assembling process is reduced. Yield ratio is increased and the cost is decreased.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A method for mounting a cross type supporter for a notebook computer keyboard comprising the steps of:

(1) at first, crossing a first supporter and a second supporter;

(2) then, placing a pivotal shaft of a first supporter into a through hole;

(3) then, placing a semi-product from steps (2) on a first platform, moving the first platform and a computer keyboard to be mounted to a predetermined position by a feeding cylinder;

(4) next, driving the second platform and the press plate so that the press plate presses the computer keyboard to be mounted and pushing a lower end of the second supporter into a through hole; and (5) next, driving the press plate to move horizontally so that the second supporter moves towards the first supporter through a predetermined distance, and thus a spacer resisting against a crossing structure formed by the first supporter and the second supporter.

2. The method for mounting a cross type supporter for a notebook computer keyboard as claimed in claim 1, wherein the first platform, second platform and press plate are respectively driven by a plurality of cylinders.

3. A system for mounting a cross type supporter upon a computer keyboard comprising:

a. a first platform having a placing surface for supporting the computer keyboard;

b. a second platform displaceably disposed in spaced manner above said first platform, said second platform being vertically displaceable relative to said first platform; and, c. a press plate suspended from said second platform for vertical displacement therewith, said press plate at least partially extending between said first and second platforms, said press plate being horizontally displaceable relative to said first platform in a manner independent of the vertical displacement, said press plate defining a lower surface portion for engaging the cross type supporter to impart a displacement force thereto.

4. The system as recited in claim 3 wherein said first platform is horizontally displaceable.

5. The system as recited in claim 3 wherein said second platform and said press plate are independently displaceable.

6. The system as recited in claim 3, further comprising a press cylinder coupled to said second platform, said press cylinder being operable to drive the vertical displacement of said second platform.

7. The system as recited in claim 3 further comprising a pull cylinder coupled to said press plate, said pull cylinder being operable to drive the horizontal displacement of said press plate.

8. The system as recited in claim 3 wherein said lower surface portion of said press plate includes a plurality of elongate protrusions, adjacent ones of said protrusions being separated one from the other by an elongate recess, each said protrusion having a stepped sectional contour.

* * * * *